US005211592A

United States Patent [19]

Alkema

[11] Patent Number: 5,211,592

[45] Date of Patent: May 18, 1993

[54] ENGINE MOUNT SYSTEM AND METHOD FOR BOATS

[75] Inventor: Robert R. Alkema, Merced, Calif.

[73] Assignee: Malibu Boats, Inc., Merced, Calif.

[21] Appl. No.: 962,942

[22] Filed: Oct. 19, 1992

[51] Int. Cl.[5] ..... B63H 21/30

[52] U.S. Cl. ..... 440/111

[58] Field of Search ..... 180/300, 299, 312; 440/111, 113; 114/357, 355; 248/637, 671, 674, 678

*Primary Examiner*—Edwin L. Swinehart

[57] ABSTRACT

A system and method is disclosed for mounting an engine into the hull of an inboard power boat. A plurality of mount elements comprised of a synthetic composition material are mounted athwart the hull and between stringers which extend lengthwise of the hull. Each mount element is formed with a mid-portion which generally conforms with the contour of the inner surface of the hull bottom. The mount elements have end portions formed with saddles which seat into cut-outs formed in the stringers. Bonding putty and fiberglass are used to integrally bond the mount elements to the hull and stringers. The engine is attached through brackets to the mount element end portions so that load forces from the engine are divided into components which are distributed across the hull and stringers.

11 Claims, 2 Drawing Sheets

ENGINE MOUNT SYSTEM AND METHOD FOR BOATS

BACKGROUND OF THE INVENTION

1. Field of the Invention

This invention relates in general to inboard power boats such as ski boats, fishing boats, pleasure boats and the like. In particular, the invention relates to engine mounting systems for power boats of this type.

2. Explanation of the Prior Art

In the prior art, inboard power boats with hulls of fiberglass or other synthetic materials have elongate stringers extending lengthwise along the interior of the hull. The stringers mount the engine and carry the engine's load, thrust, torque and vibrations. Examples of such prior art engine mount systems include U.S. Pat. Nos. 4,778,421 to Greenberg and 5,069,414 to Smith.

In power boats of this type the bilge area where the engine is contained creates a very corrosive environment. As a result the metal mounts for the engines in the prior art designs are subject to detrimental corrosion. In addition, bolts that are used to fasten engine mounts to the stringers require periodic maintenance to check for wear and tightness. If the maintenance is not properly performed then loose bolt connections can result in excessive vibration, noise and wear. The excessive vibration can also lead to stress fractures in the fiberglass of the stringers.

Accordingly, the need has been recognized for a new and improved system for mounting an engine in an inboard power boat which will obviate many of the disadvantages and limitations of the prior art engine mount systems.

OBJECTS AND SUMMARY OF THE INVENTION

It is a general object of the invention to provide a new and improved system and method for mounting an engine into a boat.

Another object is to provide a system and method of the type described which minimizes the requirements for maintenance of the engine mount elements.

Another object is to provide a system and method of the type described which distributes the load forces from the engine over the hull and stringers to achieve better dampening and for minimizing engine vibrations and noise for a quieter and smoother ride.

Another object is to provide a system and method of the type described which is relatively less expensive to build and easier to install.

The invention in summary provides mount elements of a synthetic composition material formed with mid-portions which generally conform with the bottom interior surface of a boat hull and which are attached by integral bonding with the hull. The mount elements include opposite end portions which are mounted to elongate stringers extending lengthwise of the hull. The engine is mounted to the end portions so that load forces are divided into force components which are distributed over the boat hull and stringers.

The foregoing and additional objects and features of the invention will appear from the following specification in which the several embodiments have been set forth in detail in conjunction with the accompanying drawings.

DESCRIPTION OF THE PREFERRED EMBODIMENTS

Figure 1:
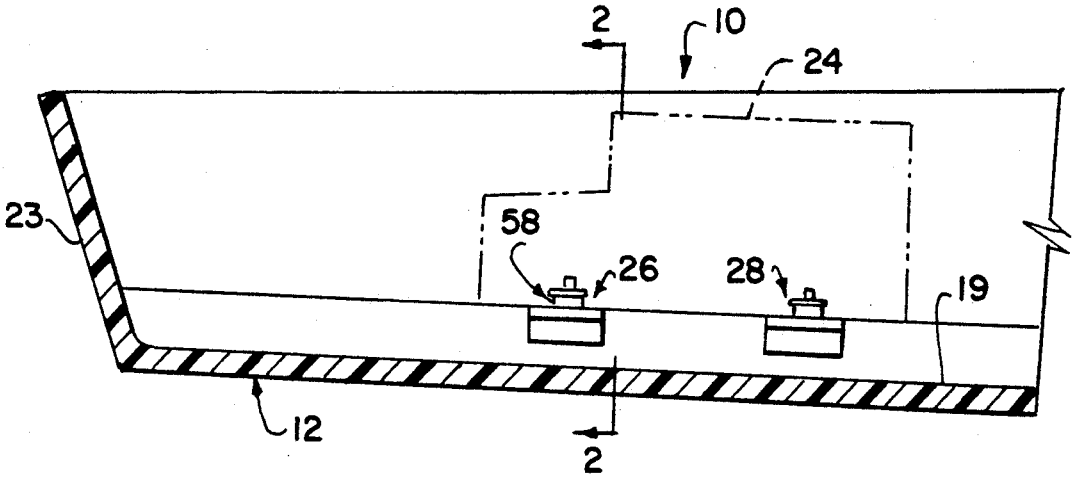
FIG. 1 is a fragmentary axial section view of the stern portion of an inboard power boat incorporating the invention.
Figure 2:
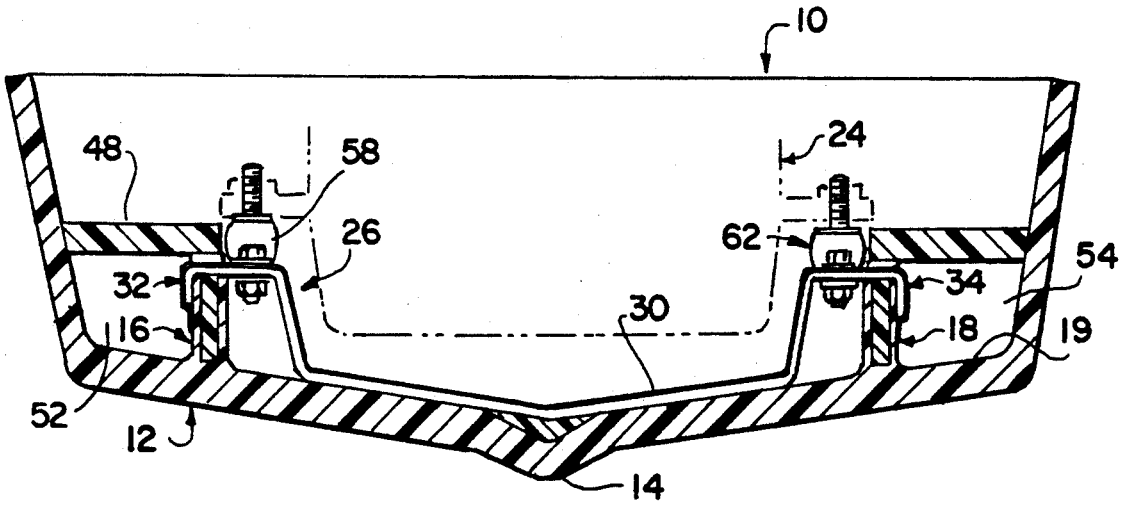
FIG. 2 is a cross-sectional view, to an enlarged scale, taken along the line 2—2 of FIG. 1.

FIGS. 1 and 2 illustrate generally the stern end of an inboard power boat 10 which incorporates a preferred embodiment of the invention. Power boat 10 is of the type incorporating a hull 12 molded of fiberglass. The hull bottom is contoured with a vee shape having a center keel 14. A pair of laterally spaced-apart elongate stringers 16, 18 extend lengthwise along the bottom interior surface 19 of the hull. In accordance with known techniques, the stringers are formed integrally with the hull by layers of fiberglass 20 bonded over a strengthening core 22 of suitable material such as expanded plastic foam, fiberglass, laminated wood or honeycomb aluminum. In a typical power boat of 20' length, the stringers extend approximately 15' forward from the boat's transom 23. While this embodiment will be described in connection with a fiberglass boat hull and stringer construction, it is understood that the invention also has application to boat hulls of other composition. For example, the invention can be used with wooden hulls in which fiberglass layers are applied over the surface of the interior hull and stringers.

Inboard engine 24 is mounted within the boat's stern portion by the mount system of the invention. In this embodiment the mount system is comprised of a pair of mount elements 26, 28 which extend athwart the longitudinal axis of the boat between the stringers. A conventional drive shaft and propeller, not shown, would also be provided in the boat. While a pair of the mount elements are illustrated, the number of such mount elements employed would depend upon the size requirements and specifications of a particular boat application.

Figure 4:
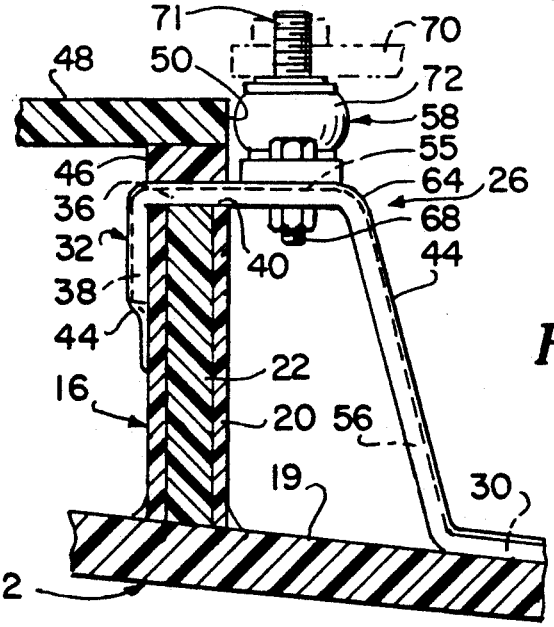
FIG. 4 is an enlarged fragmentary view of components of the boat shown in FIG. 2.

The mount element 26 is typical of the two elements and is comprised of an upwardly open, generally U-shaped mid-portion 30 and two opposite end portions 32, 34. The lateral cross section of each mount element is substantially flat, and the mid-portion is shaped so that its bottom surface generally conforms with the vee contour of the hull's interior surface 19, as best shown in FIG. 2. The end portions 32 and 34 are formed with downwardly directed, generally U-shaped saddles 36 having downwardly turned outer margins 38. At each mount element location a pair of opposed cut-outs 40, 42 are formed in the stringers for seating the saddles. As best shown in FIG. 4 the outer margins 38 of the saddles are bent downwardly from the cut-outs to contact with the outer surfaces of the stringers.

The mount elements are fabricated of a synthetic composition material providing strength, durability and resistance to flexing when supporting the engine. A preferred method of fabrication is by using aluminum molds to build up the elements with a DCPD resin and multiple layers of E-glass matt, E-glass roving, E-glass knitted bi-directional fabrics, Kevlar cloth and carbon graphite cloth.

Mount elements 26 and 28 are bonded to the stringers and interior surface of the hull to provide a permanent, secure and integral mount with the hull structure. In the bonding process the lower surfaces of the mid-portion and saddles of each mount element are coated with a suitable bonding putty. The mount element is then fitted so that its mid-portion is bonded in juxtaposed relationship with the hull's interior surface while the outer portions of the saddle are bonded to the stringer cut-outs. Additional fiberglass layers 44 covered with the bonding putty are then laid across adjacent surfaces of the mid-portions, hull, end portions and stringers to integrate the mount element into the hull. Cut-to-size spacers 46 are attached above the saddles along the length of each cut-out. The boat's floor 48 is then fitted in place. The floor is formed with an opening 50 around the engine location. The inner edge portion of the floor around the opening is oriented so that it overlies the upper edges of the spacers. This closes the cavities 52 and 54 which are formed below the floor and between the hull and stringers. A suitable expanded polyurethane plastic, not shown, is then injected into these cavities, as is well known.

The mount elements are shaped so that they combine to transfer the engine's load forces including weight, thrust and vibrations across the hull and stringers. The end portions are formed so that the flat top portions 55 of the saddles are joined with downwardly and inwardly inclined arms 56 which form continuations of the mid-portions, as best illustrated in FIG. 4 for the typical mount element 26.

The engine is secured to the mount elements by means of four mounting brackets 58–62. For each mount element the attachment point of the engine mounting bracket lies between the inner side of the stringer and the bight 64 between flat top portion 55 and inclined arm 56. At the attachment points vertically axised through openings 66 (FIG. 3) are formed in the flat top portion of each saddle for receiving mounting bolts 68. This location of the attachment point divides the load forces from the engine into a first force component which is transferred to inclined arm 56 and a second force component which is transferred to stringer 16. The first force component in turn is transferred to the boat hull by mid-portion 30 of the mount element.

Figure 3:
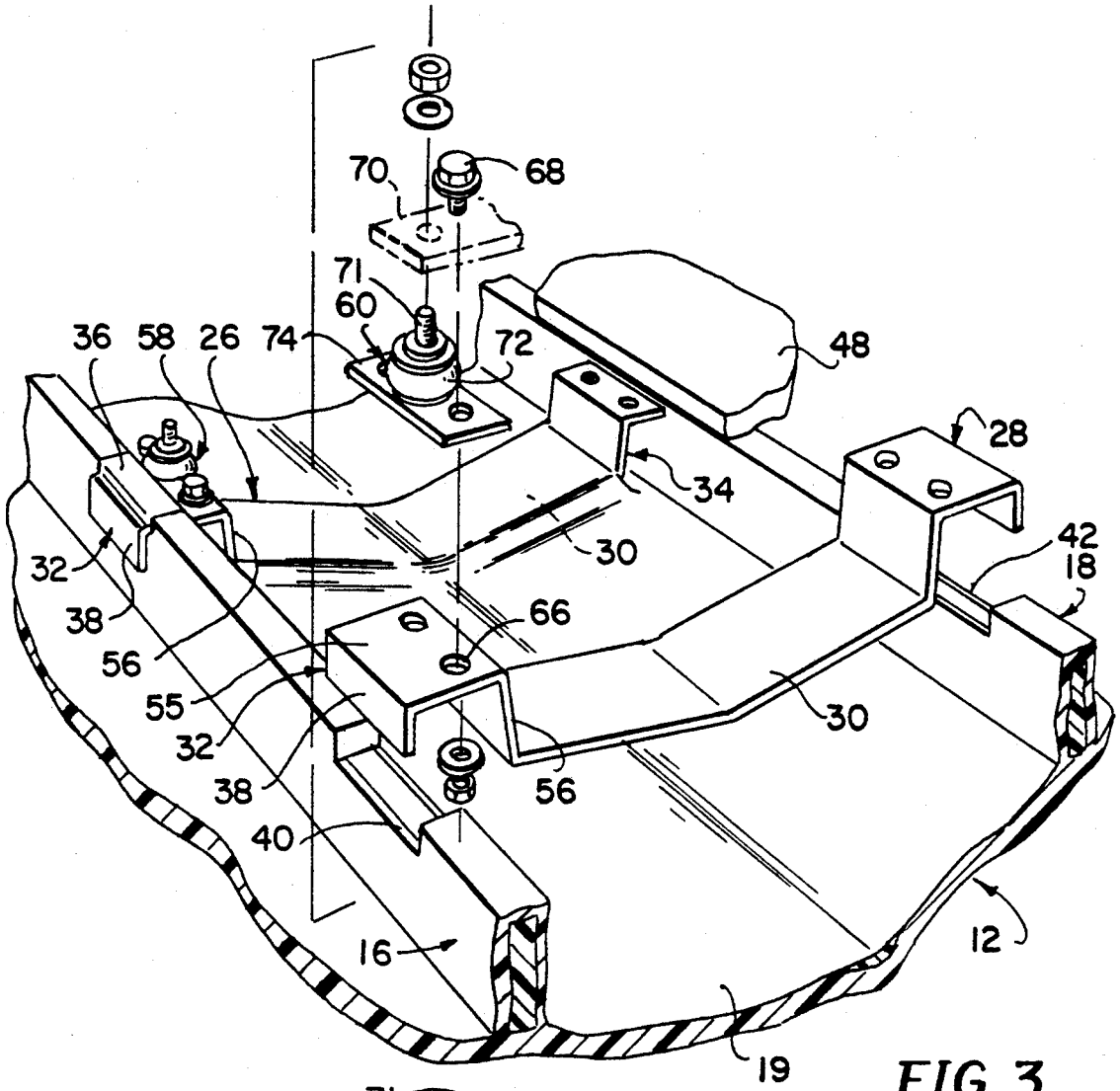
FIG. 3 is a fragmentary perspective view, partially exploded, showing components of the embodiment of FIGS. 1–2.

FIGS. 3 and 4 illustrate details of the typical mount bracket 58 for securing the engine to the mount elements. Each of the four sides of the engine have a mounting pad 70 secured by a bolt 71 to an elastomeric bushing 72 which transfers the load to a bracket 74. The bolts 68 secure bracket 74 to the top portion of the mount element.

An example of the invention will be explained in connection with a typical power boat of 20' length fitted with an engine in the range of 250–300 hp having a weight of 800 lbs. A pair of mount elements 26, 28 are provided, each of which has length athwart the boat of 30", a width lengthwise of the boat of 8" and a 7" depth measured from flat top portion 55 to the lower extent of the vee in mid-portion 30. The mount elements are formed of the synthetic composition material described above with an overall thickness of 0.5". Bonding putty and layers of fiberglass applied as described above permanently secure and integrate the mounts into the hull and stringers. The engine is then secured in place by means of mounting brackets 58–62.

The mount elements of the invention divide the various load forces from the engine into components which are transferred across the hull bottom and stringers. This provide an optimum distribution of the load in that vibrations and engine noise are better dampened by the greater combined mass of the entire hull, thereby creating a quieter and smoother ride for the passengers. The integral attachment of the mount elements to the hull and stringers minimizes the effects of the corrosive environment in the bilge in that the synthetic composition material of the mount elements will last as long as the hull. Maintenance requirements are also reduced because the system does not employ bolts to fasten the engine mounts to the stringers, thereby obviating the need to regularly check for wear and tightness, which would otherwise be required at these points of connection. The engine mount system of the invention is also less expensive to fabricate and easier to install than prior art systems for mounting inboard engines.

While the foregoing embodiments are at present considered to be preferred, it is understood that numerous variations and modifications may be made therein by those skilled in the art and it is intended to cover in the appended claims all such variations and modifications as fall within the true spirit and scope of the invention.

What is claimed is:

1. A mount system for mounting an engine into a boat having a hull with a contoured interior surface which carries parallel, laterally spaced-apart elongate stringers extending lengthwise of the hull, the mount system comprising the combination of at least one mount element comprised of a strong synthetic composition material, each said mount element being formed with an upwardly open, generally U-shaped mid-portion and two opposite end portions, said mid-portion having a bottom surface shaped to generally conform with the contour of the interior surface of the hull bottom, said end portions being mounted to upper portions of the stringers, and attachment means for orienting each said mount element in a position extending laterally of the hull between the stringers and for bonding said bottom interior surface of the mid-portion to the bottom surface of the hull.

2. A mount system as in claim 1 in which said attachment means includes means for bonding the end portions of each said mount to said upper portions of the stringers.

3. A mount system as in claim 2 in which said end portions of each said mount element are generally fat and are formed with vertically axised openings, and bolt means extending through said openings for securing the engine to each said mount element.

4. A mount system as in claim 2 in which said upper portions of the stringers are formed with cut-outs, said end portions of each said mount are formed with downwardly directed generally U-shaped saddles, and said attachment means includes means for fixedly mounting the saddles into the cut-outs.

5. A mount system as in claim 4 for use in a boat includes a floor mounted over the stringers, further characterized in that said means for fixedly mounting the saddles includes means for orienting edge portions of the floor above respective saddles for holding such saddles against displacement from the cut-outs.

6. A mount system as in claim 5 in which said saddles are formed with substantially flat top portions, and including fastener means carried on the flat top portions of the saddles for securing the engine to each said mount element.

7. A mount system as in claim 5 in which said saddles further include means forming downwardly inclined arms which are laterally spaced inwardly from the stringers and which join with each said mount element mid-portion for dividing load forces from the engine into first and second force components with the first force component being transferred through the inclined arms to said mid-portion and thence to the hull, and with the second force component being transferred through the saddles to the stringers.

8. A mount system as in claim 1 in which a pair of said mount elements are oriented in longitudinally spaced-apart relationship within the hull.

9. A inboard power boat providing a substantially maintenance-free engine mount, comprising the combination of a hull having a contoured interior surface, a plurality of elongate stringers mounted on said hull interior surface lengthwise of the boat, a plurality of U-shaped mount elements each of which has a mid-portion conforming in contour with said interior surface of the hull, said mount elements further having end portions, means for fixedly bonding the mid-portions of the mount elements to said hull interior surface, means for fixedly securing said end portions of the mount elements to the stringers, an engine, and means for attaching said engine to the end portions at predetermined positions thereof for causing load forces from the engine to be divided into first components which are transferred through the mid-portions to the hull and second components which are transferred through the end portions to the stringers.

10. A method of mounting an engine into a boat having a hull with a contoured interior surface which carries parallel, laterally spaced-apart stringers extending lengthwise of the boat, the method including the steps of forming a mount element into a mid-portion and opposed end portions with the mid-portion having a bottom surface which generally conforms with the contour of said interior surface of the hull, integrally bonding the bottom surface of said mid-portion to the interior surface of the hull, integrally bonding the end portions of the mount element to laterally aligned portions of respective stringers, and securing the engine to the end portions with load forces from the engine being transferred through the mount element to both the stringers and the hull.

11. A method as in claim 10 including the steps of transferring the load forces from laterally opposite sides of the engine onto respective midspans of the end portions, dividing the load forces at each end portion midspan into first and second force components with the first force component being transferred to the mount element from one side of the end portion and the second force component being transferred to a respective stringer from a side of the end portion opposite said one side.

* * * * *